US005368272A

United States Patent [19]

Badstieber

[11] Patent Number: 5,368,272

[45] Date of Patent: Nov. 29, 1994

[54] FORMWORK PANEL HAVING AT THE EDGES THEREOF PROJECTING EDGE WEBS OF FLAT MATERIAL

[75] Inventor: Johann Badstieber, Rutesheim, Germany

[73] Assignee: Paschall-Werk G. Maier GmbH, Steinach, Germany

[21] Appl. No.: 98,322

[22] PCT Filed: Feb. 6, 1992

[86] PCT No.: PCT/DE92/00079

§ 371 Date: Aug. 6, 1993

§ 102(e) Date: Aug. 6, 1993

[87] PCT Pub. No.: WO92/14013

PCT Pub. Date: Aug. 20, 1992

[30] Foreign Application Priority Data

Feb. 8, 1991 [DE] Germany ..... 4103775

[51] Int. Cl.[5] ..... E04G 17/04

[52] U.S. Cl. ..... 249/192; 249/44; 249/47; 249/195; 249/196

[58] Field of Search ..... 249/47, 189, 192, 193, 249/194, 195, 196, 219.1, 44

[56] References Cited

U.S. PATENT DOCUMENTS

| | | | |
|---|---|---|---|
| 2,870,516 | 1/1959 | Jennings | 25/131 |
| 3,414,230 | 12/1968 | Brosseau | 249/193 |
| 4,529,163 | 7/1985 | Dringler | 249/192 |
| 4,821,995 | 4/1989 | Merkel | 249/192 |
| 4,881,716 | 11/1989 | Dingler | 249/192 |
| 5,273,251 | 12/1993 | Badstieber | 249/189 |

FOREIGN PATENT DOCUMENTS

| | | | |
|---|---|---|---|
| 2515716 | 5/1983 | France | 249/196 |
| 2566821 | 1/1986 | France . | |
| 1957385 | 5/1971 | Germany . | |
| 2403325 | 11/1976 | Germany . | |
| 2716864 | 10/1978 | Germany . | |
| 2747064 | 5/1979 | Germany | 249/196 |
| 2137505 | 11/1980 | Germany . | |
| 3601006 | 7/1987 | Germany | 249/196 |
| 3718615 | 12/1988 | Germany . | |
| 3728503 | 3/1989 | Germany . | |
| 7005403 | 10/1971 | Netherlands . | |
| 81206388 | 7/1992 | Taiwan, Prov. of China . | |

*Primary Examiner*—Khanh Nguyen
*Attorney, Agent, or Firm*—Darby & Darby

[57] ABSTRACT

A formwork panel has a board and a frame for the board. The frame is made up of strips of sheet material which extend along respective edges of the board and project from the edges at right angles to the board. Each strip has a flat longitudinal marginal portion adjacent to the board and a flat longitudinal marginal portion remote from the board. The marginal portions of a strip are located in a common plane. Each strip further has two protrusions which respectively extend from the marginal portions of the strip towards the opposite strip of the frame and define recesses opening away from the opposite strip. A protuberance is disposed between the two protrusions of a strip. Each protuberance extends from the adjoining protrusions away from the opposite strip and defines a depression opening towards the opposite strip.

16 Claims, 1 Drawing Sheet

FORMWORK PANEL HAVING AT THE EDGES THEREOF PROJECTING EDGE WEBS OF FLAT MATERIAL

FIELD OF THE INVENTION

The invention relates to a formwork panel having at the edges thereof edge webs which project at right angles to the forming surface and are made of flat material, the cross section of the edge webs running from the forming surface to a free edge. This cross-sectional course is directed away from the forming surface at least at the free edge and the free edge limits the greatest width of the edge web. In the position of use, the edge webs have lying indirectly or directly thereagainst the edge webs of neighbouring formwork panels and are engaged by connecting means for fastening together the edge webs lying against ore another.

BACKGROUND OF THE INVENTION

Such a formwork panel where the edge webs of aligned and contiguous formwork panels lie directly against one another is known from German Patent Specification No. 21 37 505. Bolts traversing keyhole-like openings in the edge webs serve as the connecting means for fastening together the edge webs lying against one another and have a stop projection and a counter-stop arranged in spaced relationship thereto.

German Patent Specification No. 24 03 325 discloses comparable formwork panels where the edge webs of adjacent formwork panels lie indirectly against one another, that is to say, intermediate parts or spacers are provided between them, while compensating elements may also be provided between such edge webs of aligned, neighbouring formwork panels.

In these known solutions, the edge webs are plane to enable them to lie tightly against one another or to enable intermediate parts to be inserted. However this results in that the stiffness of these edge webs is limited and hence the formwork panels can have only a limited loading capacity.

It is therefore also known, e.g. from German Offenlegungsschrift 27 16 864, to use hollow sections instead of edge webs of flat material. Hollow sections have a greater stiffness, but they also lead to edge webs with large cross sections and correspondingly elaborate connecting means, as well as to considerably higher weights of the formwork panels. In the case of the profiled edge webs according to German Offenlegungsschrift 27 16 864, a C-shape has been selected as the cross section, wherein that free edge of the section which is remote from the forming surface is directed towards the latter and hence does not limit the greatest width of this edge section.

SUMMARY OF THE INVENTION

The object underlying the invention is therefore to provide a formwork panel of the kind mentioned at the outset, in which the edge webs may be of flat material, but one can nevertheless attain a high stiffness accompanied by good sealing of edge webs lying against one another.

This object is accomplished in that between the two aligned longitudinal edges of the edge web which serve as a seating for the edge web of the neighbouring formwork panel is an area receding relative to these longitudinal edges in a direction towards the centre of the formwork panel. In this receding area is at least one oppositely recessed channel or bead open towards the centre of the formwork panel.

The solution is based on the realization that, as is already known from hollow sections, it is sufficient for sealing abutting edge webs if in each case two edge areas are available as sealing surfaces and seating surfaces. Therefore considerably greater stiffness can be imparted to the edge web consisting of flat material through the described shaping of its crosspiece, as compared with an edge web which is plane throughout. In addition, the further advantage ensues that clamps can have their clamping jaws applied to the beads in the manner as is also known when the edge webs are constituted by hollow sections. Hence these edge webs presenting a stiffened cross-sectional profile but nevertheless consisting of flat material can be engaged by clamps as the connecting means. Clamps have the advantage that they permit of being applied to virtually any locations of the edge webs, and that they allow for a high clamping force and thereby enable good sealing of abutting edge webs or of interposed compensating elements or the like. Nevertheless the total weight of the formwork panel can be kept lower, because the substantially heavier edge sections are replaced by edge webs of flat material which present greater stiffness than plain ones.

It is particularly advantageous if the outer surface of the bead devised for engagement of a clamp is at a distance to a plane contacting the two corresponding outer surfaces of the longitudinal edges of the web. It is sufficient, but at the same time also advantageous, if the distance of the outer surface of the bead from the plane of the longitudinal edges of the web corresponds approximately to or is greater than the elastic deformability of the web when being clamped to a neighbouring web. These measures prevent that when such edge webs lie against one another the outer surfaces of the beads are supported against one another and the sealing surfaces proper fail to be pressed together sufficiently. Rather, one achieves that the entire clamping or connecting force is transferred to the edge webs at their abutting aligned longitudinal edges. The stiffer and thicker the cross sections of the edge webs are, the smaller will be the distance between the outer surface of the bead and the plane of the outer surfaces of the longitudinal edges. The cross-sectional thickness of the edge webs may be, for example, about ½ cm to about ¾ cm and particularly about 6 mm. Given a cross-sectional thickness of about 6 mm, a distance of the outer surface from the plane of the longitudinal edges in the order of about ½ to 1 mm is sufficient in order to achieve on the one hand the desired firm contact pressure of the aligned longitudinal edges and sealing surfaces of the edge webs and on the other hand to allow for elastic deformation under the influence of the clamping force.

It is suitable for the exterior surfaces of the two longitudinal edges of the edge webs to be plane and in alignment and the width at least of the longitudinal edge closer to the forming surface may at least approximate at least the thickness of this forming surface. However, both longitudinal edges may suitably be of the same width in order that a symmetrical cross section ensues and the bead can also be arranged in the centre of the edge webs.

That area of the edge webs which, in relation to the longitudinal edges, recedes towards the centre of the formwork panel may be plane except for the bead. This area is thereby available in order to allow, for example, further stiffening webs to butt and to be welded to the edge webs. In addition, a sleeve for a tie could in this way be fixed to the inside or inner surface of the edge webs. Further, in this way supports or brackets could be attached to the edge webs.

The bead arranged in the longitudinal direction of the edge web—particularly in the centre thereof—may run uninterrupted and particularly with uniform cross section throughout the length of the edge web. Therefore a clamping device can be applied to virtually any location of the edge web. Further, in this way the edge webs can be made from an originally plane, flat material in a continuous profiling process.

Holes traversing the edge webs, e.g. for attaching connecting bolts or the like, may be provided in the area of the bead. With the use of such connecting bolts, adjacent formwork panels can be fastened together or accessories such as working platforms, shores and the like can be coupled to abutting edge webs of adjacent formwork panels. The arrangement of these coupling holes in the area of the beads has the advantage that the clamping forces applied in the longitudinal direction of the bolts are introduced at the beads provided for them.

The holes provided in the area of the beads may have a circular cross section and their diameter can in particular approximate the greatest width of the bead, so that the walls of the holes also traverse the lateral boundaries of the bead. Therefore, the head of a connecting bolt and also a nut cooperating with a threaded stud can rest against the surface which faces the centre of the formwork and forms part of that area of the edge webs which recedes at the side of the bead.

The transitions from the longitudinal edges to the central area of the edge web and/or the lateral boundaries of the bead may run at a slant relative to the cross-sectional contour of the edge web, for example at an angle of about 45 degrees. This produces not only a good stiffening, but also permits the desired shaping of the cross section of the edge web, without the danger of damage or weakening during the profiling process.

The invention thus provides a formwork panel which is of relatively low weight because its edge webs can consist of flat material. It is nevertheless possible for great forces to be transferred and for clamping devices to be used for connecting neighbouring formwork panels. The advantages of formwork panels with flat edge webs are combined with the advantages displayed by formwork panels with edge webs composed of hollow sections without a considerable increase in weight.

BRIEF DESCRIPTION OF THE DRAWINGS

An exemplary embodiment of the invention is described in more detail below with reference to the drawings in which.

DESCRIPTION OF PREFERRED EMBODIMENTS

Figure 1:
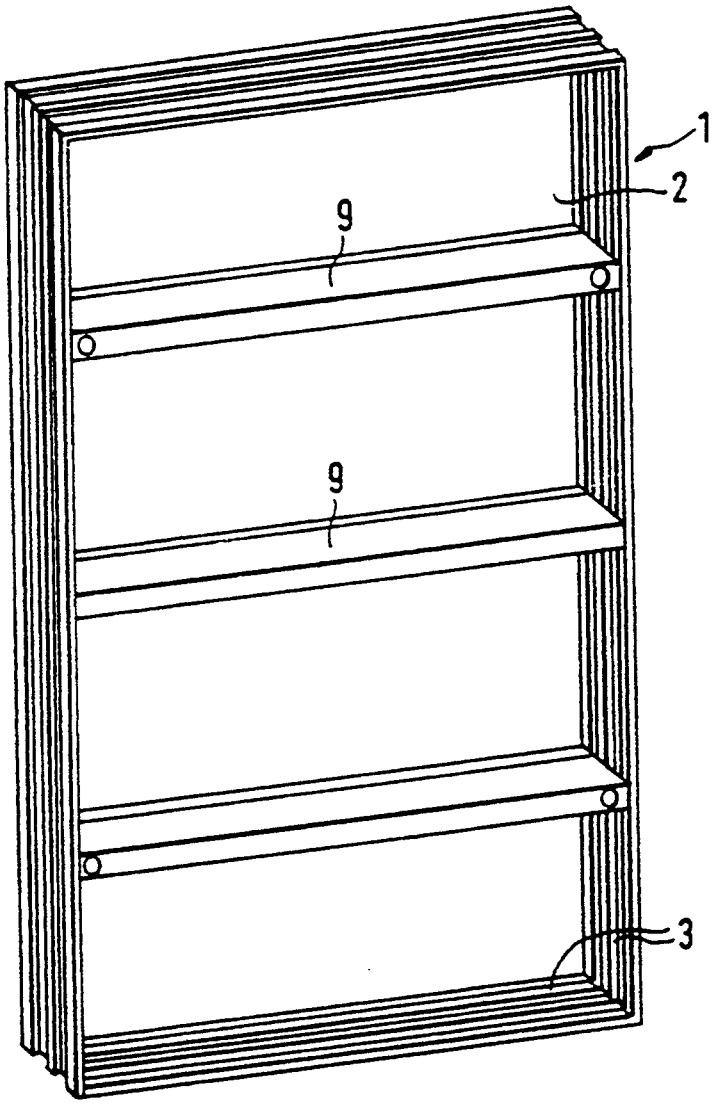
FIG. 1 is a diagrammatic rear view of a formwork panel according to the invention having profiled edge webs of flat material running round the edges and transverse stiffening sections arranged inbetween.

A formwork panel 1 has running round the edges thereof edge webs 3 of flat material which project at right angles to its forming surface 2. In the position of use, the edge webs have lying indirectly or—according to FIG. 2—directly thereagainst the corresponding edge webs 3 of neighbouring formwork panels 1 and are connected with the aid of fasteners, in the exemplary embodiment with the aid of a clamping device 4.

Figure 2:
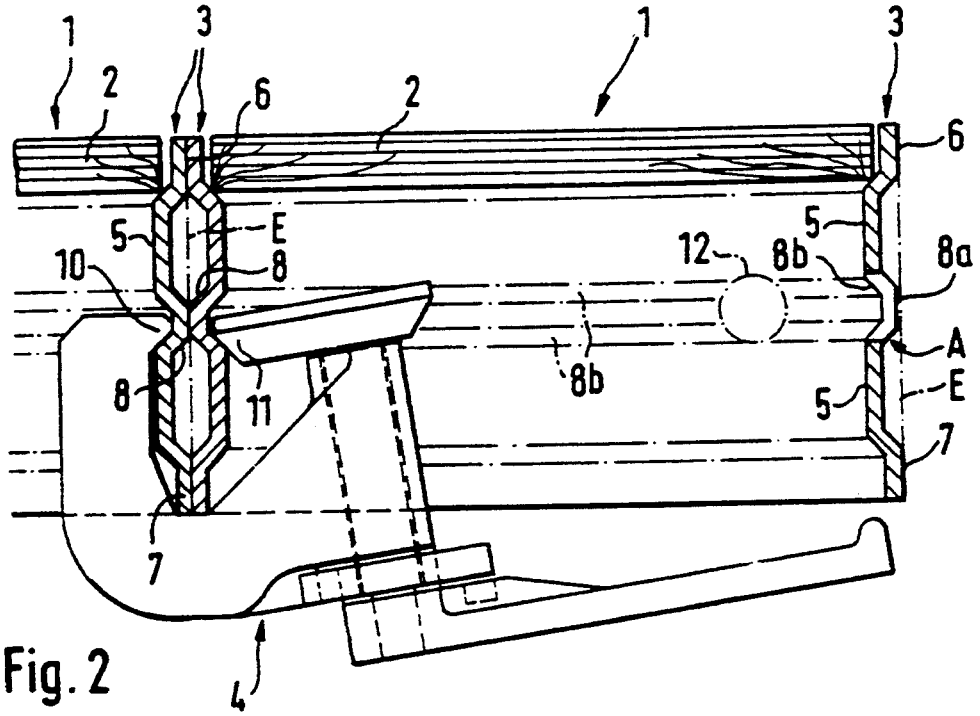
FIG. 2 is a section through mutually opposed edge webs of the formwork panel with a neighbouring formwork panel fastened thereto, the edge webs in contact being held together by a clamping device.

It is clear particularly with reference to FIG. 2 that the cross section of the edge webs 3 runs from the forming surface 2 to a free longitudinal edge 7, this free edge 7 limiting the greatest width of the edge web 3 and being directed away from the forming surface 2.

The cross sections of the edge webs 3 in FIG. 2 illustrate that between the two aligned longitudinal edges 6 and 7 of the edge web 3 which serve as a seating for the edge web 3 of the neighbouring formwork panel 1 is an area 5 receding relative to these longitudinal edges 6 and 7 in a direction towards the centre of the formwork panel 1. In this receding area 5 is an oppositely recessed channel or bead 8 open towards the centre of the formwork panel. FIG. 2 illustrates that a bead 8 of an edge web 3 cooperates with the bead 8 of the edge web 3 of the neighbouring formwork panel 1, when the clamp 4 engages these beads 8 to connect the formwork panels 1. Through the clamping force, the confronting outer surfaces 8*a* of the beads 8 are brought closer to one another or are even pressed together. In the starting position, however, where there is no deformation by the clamping force, the outer surfaces are at a distance to a plane contacting the two outer surfaces of the longitudinal edges 6 and 7 of the webs 3. It is thereby ensured that in the position of use the longitudinal edges 6 and 7 of the webs 3 come into contact with one another and lie tightly against one another, and that there is no premature contact of the outer surfaces 8*a* of the beads 8 which could prevent firm contact between the longitudinal edges 6 and 7. In addition, due to the resilience of the edge webs 3, a corresponding pressure force can be generated and transferred in the area of the longitudinal edges 6 and 7.

It is suitable if the distance A of the outer surface 8*a* of the bead 8 from the plane E of the longitudinal edges 6 and 7 of the web 3 corresponds approximately to or is even greater than the maximum elastic deformability of the edge web 3 when being clamped to a neighbouring web, so that contrary to the representation of FIG. 2 the outer surfaces 8*a* of abutting edge webs 3 do not come into contact.

FIG. 2 illustrates that the exterior surfaces of the two longitudinal edges 6 and 7 of the edge web 3 are plane, namely lie in plane E, and are in alignment. The width at least of the longitudinal edge 6 closer to the forming surface 2 approximates the thickness of this forming surface 2, so that the receding area 5 can begin directly at the rear of the forming surface 2, but the forming surface can reach up to the inside of the longitudinal edge 6, except for a sealing joint. In the exemplary embodiment, both longitudinal edges 6 and 7 are of the same width. An essentially symmetrical configuration of the edge web 3, which is stiffened by the receding area 5 on the one hand and by the bead 8 on the other hand, is then achieved if—as in the exemplary embodiment—the bead 8, which extends in the longitudinal direction of the edge web 3 and runs uninterrupted and with uniform cross section throughout the length of the edge web 3, is arranged in the centre of the cross section of the edge web 3. The area 5 of the edge webs 3 which, in relation to the longitudinal edges 6 and 7, recedes towards the centre of the formwork panel 1 is plane except for the bead 8. Therefore, when butting against these areas 5, stiffening sections 9 arranged transversely to the edge webs 3 find a good support and a correspondingly wide area for the provision of a weld seam. Further, in this way a clamp 4 can be pushed over abutting edge webs 3 without excessive movement of its clamping jaws 10 and clamping pieces 11. The edge webs 3 may be traversed, particularly in the areas of their beads 8, by holes 12 at which fastening bolts may be arranged instead of or in addition to the clamp 4. While the clamp 4 permits a fastening at virtually any area of the edge webs 3, fastening bolts can be provided at preselected locations with the aid of the holes. In addition, accessories such as brackets or supports can be fixed with such fastening bolts.

It is indicated in FIG. 2 that the holes 12 provided in the area of the beads 8 have a circular cross section and that diameter corresponds approximately to the greatest width of the beads 8, so that the walls of the holes also traverse the lateral boundaries **8*b* of the beads 8. Hence the plane zones which form part of the receding areas 5 and are adjacent to the holes 12** are available as a support for a head or a nut or a projection of a fastening bolt.

The transitions from the longitudinal edges 6 and 7 to the central area 5 of the edge web 3 and the lateral boundaries **8*b* of the bead 8 are at a slant relative to the cross-sectional contour of the edge web 3, in the exemplary embodiment at an angle of about 45 degrees. This has the result that the transitions from abutting edges 6** together form approximately a right angle which constitutes a good compromise from the viewpoint of metal forming on the one hand and from the viewpoint of introducing clamping forces on the other hand.

The formwork panel 1 is of great stiffness. The edge webs 3, although made of flat material, also display great stiffness by virtue of their cross-sectional shape, while being of relatively low weight. At the same time, a clamp 4 with relatively small jaw displacement is sufficient in order to be able to connect the edge webs. Since the bead 8 enhancing the stiffness allows a clamp 4 to be applied, the holes 12 can be dispensed with. Further, with the aid of a clamp 4, a connection can be established at virtually any location of the contacting edge webs 3. Hence the advantages accruing from the relatively low weight of the edge webs 3 consisting of flat material are combined with the possibility of being able to apply clamps at any points of contact, and hence of not being dependent on given hole spacings. Consequently on the one hand the beads 8 have the function of increasing the stiffness of the edge webs 3 and on the other hand they fore a convenient point of engagement for the clamp 4.

In order to save weight, instead of having hollow sections, the formwork panel 1 has at the edges thereof edge webs 3 which are made of flat material and project at right angles to the forming surface 2. To increase the stiffness, the edge webs 3 have between their two aligned longitudinal edges 6, 7 serving as a seating for the edge web 3 of a neighbouring formwork panel 1 an area 5 receding towards the centre of the formwork panel 1. Within this area 5, there is an oppositely recessed channel or bead 8 open towards the centre of the formwork panel. In this way, an edge web 3 of flat material and high stiffness is obtained. It is possible for ordinary clamps 4 to be applied to its bead 8 without a need for the high weight of hollow sections. The cross-sectional thickness of the edge webs 3 may be, for example, about ½ cm or 0.6 cm and the distance of the outer surface **8*a* of the bead 8** from the plane E may be between ½ and 1 mm, possibly also somewhat more.

I claim:

1. A formwork panel, comprising a forming element having a forming surface and a pair of opposed edges; and a rim projecting from one of said edges transverse to said surface, said rim having a substantially flat first marginal portion disposed adjacent said element in a predetermined plane, a substantially flat second marginal portion in said predetermined plane at a spacing from said element, a protrusion between said marginal portions extending from said predetermined plane towards the other of said edges and defining a recess which opens away from said other edge, and a protuberance extending from said protrusion away from said other edge and defining a depression which opens towards said other edge, said rim being free of folds wherein said rim has a second protrusion between said marginal portions extending from said predetermined plane towards said other edge and defining a second recess which opens away from the other edge, said protuberance extending from said second protrusion.

2. The formwork of claim 1, wherein said rim is substantially perpendicular to said surface.

3. The formwork of claim 1, wherein said second marginal portion has a free end face which faces away from said element.

4. The formwork of claim 1, wherein each of said marginal portions has a surface which faces away from said other edge, said surfaces of said marginal portions being located in a common plane, and said protuberance having a surface which faces away from said other edge and is spaced from said common plane in a direction towards said other edge.

5. The formwork of claim 4, wherein said rim has a maximum elastic extensibility and said surface of said protuberance is spaced from said common plane by a distance which is approximately equal to or exceeds said extensibility.

6. The formwork of claim 1, wherein said element has a predetermined thickness and said first marginal portion has a predetermined width which is at least approximately equal to said predetermined thickness.

7. The formwork of claim 6, wherein said marginal portions have substantially the same width.

8. The formwork of claim 1, wherein said protrusion has a substantially flat section spaced from said predetermined plane.

9. The formwork of claim 1, wherein said rim is elongated along a direction substantially parallel to said surface and has a predetermined length, said protuberance extending longitudinally of said rim along substantially the entire predetermined length of said rim.

10. The formwork of claim 9, wherein said protuberance has a substantially constant cross section throughout.

11. The formwork of claim 1, wherein said protuberance is provided with at least one opening.

12. The formwork of claim 11, wherein said protuberance has a predetermined width and the size of said opening is at least approximately equal to said predetermined width.

13. The formwork of claim 12, wherein said opening has a substantially circular cross section of diameter at least approximately equal to said predetermined width.

14. The formwork of claim 1, wherein said protrusion and said protuberance each have a marginal section and at least one of said marginal sections is inclined to said predetermined plane.

15. The formwork of claim 14, wherein said one marginal section is inclined to said predetermined plane at an angle of about 45 degrees.

16. The formwork of claim 1, wherein said rim is formed from flat material.

* * * * *

UNITED STATES PATENT AND TRADEMARK OFFICE

CERTIFICATE OF CORRECTION

PATENT NO. : 5,368,272

DATED : November 29, 1994

INVENTOR(S) : Johann BADSTIEBER

It is certified that error appears in the above-indentified patent and that said Letters Patent is hereby corrected as shown below:

On the title page item [73], should read

--Paschal-Werk G. Maier GmbH, Steinach, Germany--.

Signed and Sealed this

Twenty-seventh Day of June, 1995

*Attest:*

*Attesting Officer*

BRUCE LEHMAN

*Commissioner of Patents and Trademarks*